US006189189B1

(12) United States Patent
Morin et al.

(10) Patent No.: US 6,189,189 B1
(45) Date of Patent: Feb. 20, 2001

(54) METHOD OF MANUFACTURING LOW CONTAMINANT WIPER

(75) Inventors: Brian G. Morin, Greer; Daniel T. McBride, Chesnee, both of SC (US); Loren W. Chambers, LaGrange, GA (US)

(73) Assignee: Milliken & Company, Spartanburg, SC (US)

( * ) Notice: Under 35 U.S.C. 154(b), the term of this patent shall be extended for 0 days.

(21) Appl. No.: 08/976,225

(22) Filed: Nov. 21, 1997

(51) Int. Cl.[7] ..... B65H 71/00

(52) U.S. Cl. ..... 28/166; 28/170; 66/170; 66/169 R; 15/208; 15/209.1; 15/210.1

(58) Field of Search ..... 15/208, 209.1, 15/210.1; 442/181, 308; 53/427; 66/170, 169 R; 28/166, 170

(56) References Cited

U.S. PATENT DOCUMENTS

| | | | |
|---|---|---|---|
| 3,902,299 | 9/1975 | Zeidell | 53/431 |
| 4,888,229 | 12/1989 | Paley et al. | 428/192 |
| 5,069,735 | 12/1991 | Reynolds | 156/497 |
| 5,229,181 | 7/1993 | Daiber et al. | 428/58 |
| 5,271,995 | 12/1993 | Paley et al. | 442/181 |
| 5,320,900 | 6/1994 | Oathout | 442/408 |
| 5,460,655 | 10/1995 | Pisacane et al. | 134/6 |
| 5,736,469 * | 4/1998 | Bhattacharjee et al. | 442/110 |

OTHER PUBLICATIONS

Perovic, Aleksandra; "Morphological instability of poly(ethylene terephthalate) cyclic oligomer crystals"; *Journal of Materials Science 20 (1985)*; pp. 1370–1374.

Perovic, A. and Sundararajan, P.R.; Crystallization of Cyclic Oligomers in Commercial Poly(ethyleneterephthalage) Films; *Polymer Bulletin 6 (1982)*; pp. 277–283.

Cimecioglu, A.L. et al.; Properties of Oligomers Present in Poly(ethylene Terephthalate); *Journal of Applied Polymer Science*, vol. 32 (1986); pp. 4719–4733.

Institute of Environmental Sciences, Contaimination Control Division; *Evaluating Wiping Materials Used in Cleanrooms and Other Controlled Environments* (IES–R-P–CC0–004.2).

* cited by examiner

*Primary Examiner*—Terrel Morris
*Assistant Examiner*—John J. Guarriello
(74) *Attorney, Agent, or Firm*—Terry T. Moyer; Timothy J. Monahan

(57) ABSTRACT

A method of manufacturing a polyester textile fabric having a relatively low level of particulate contaminates and high absorbency is provided by heatsetting the fabric at a temperature of 300° F. or less.

13 Claims, 1 Drawing Sheet

METHOD OF MANUFACTURING LOW CONTAMINANT WIPER

BACKGROUND OF THE INVENTION

This invention relates to the manufacturing of polyester fabric for wipers, in particular, wipers which release fewer particulate contaminates.

Wipers may be made from knitted, woven or non-woven polyester fabrics. The typical manufacturing process begins with drawing and texturing continuous filament polyester yarn. The textured yarn is knitted or woven to construct a fabric, and the fabric is washed or scoured to remove spinning oils. The fabric may be chemically modified in order to improve its wettability and performance. The fabric is then dried in a "tenter frame" oven at a temperature of between 325 and 450° F., to remove moisture and heat set the fabric. Heat setting dissipates stress in the polyester fibers and stabilizes the fabric.

Next, the fabric is cut into wipers, typically 9 inch by 9 inch squares. The wipers may remain unlaundered or may be washed in a cleanroom laundry, employing special surfactants and highly-filtered and purified water, to reduce the contamination present on the fabric. After washing, the wipers may be packaged dry in air-tight plastic bags, or pre-saturated with a suitable solvent before being packaged, and are ready for use.

These wipers are utilized for a number of different applications, including cleaning within cleanrooms, automotive painting rooms and other cleanroom environments. Each different application emphasizes certain standards these types of wipers should attain. For example, for wipers utilized in cleanrooms, stringent performance standards must be met. These standards are related to sorbency and contamination, including maximum allowable particulate, unspecified extractable matter and individual ionic contaminants. The standards for particulate contaminant release are especially rigorous and various methods have been devised to meet them. For example, Paley et al., U.S. Pat. No. 4,888,229, describes a wiper having fused borders, the sealed edge of the wipers being present to reduce contamination caused by small fibers. Diaber et al., U.S. Pat. No. 5,229,181, describes a knit fabric tube, only two edges of which must be cut and sealed, thereby reducing the contamination caused by loose fibers from the edges. Paley et al., U.S. Pat. No. 5,271,995, describes a wiper for a cleanroom environment that has reduced inorganic contaminants through the use of a specific yarn, namely "nylon bright". Reynolds, U.S. Pat. No. 5,069,735, describes a procedure to cut the fabric into pieces using a hot air jet in the range of 600 to 800° F. to melt the fibers, forming a sealed edge product with reduced loose fiber contamination.

Despite advances made in reducing particulate contamination release from cleanroom wipers, further reductions in particulate release are, nevertheless, highly desirable.

SUMMARY OF THE INVENTION

Therefore, an object of the invention is to provide a low contaminant wiping cloth suitable for a wide range of applications. Another object of the invention is to provide a wiper which meets substantially all of the specifications for use in cleanrooms, particularly Class 100 cleanrooms and below, to provide an improved method of manufacturing a cleanroom wiper and to provide a wiper having a substantial reduction in particulate release. A further object of the invention is to provide a cleanroom wiper having a high liquid sorbency capacity. Yet another object of the invention is to provide a wiper which is dimensionally stable. The term dimensionally stable means, in this instance, a wiper which lies substantially flat and does not curl into a roll, especially after the wiper is laundered. Preferably, the wiper does not undergo any appreciable linear shrinkage (less than 5%) when it is exposed to a heat source of 175 degrees fahrenheit for 5 minutes.

Accordingly, a method of manufacturing a textile article for use in a cleanroom is provided having the steps of constructing a knitted or woven fabric from polyester yarn, heat setting the fabric at a temperature of from 180° to 300° F. and cutting the fabric to form the desired article; wherein the polyester fiber has not been heated above a temperature of 300° F. The invention also includes a textile article, such as a wiper, made according to the aforementioned process.

Without being bound to a particular theory, it is believed that heating the polyester fiber above 300° F. causes low molecular weight polymers or oligomers to blossom to the surface of the polyester fiber, where they crystalize into small particles. These small particles, known as "trimer particles" can number as high as $1\times10^9$ or greater particles per square meter, have a high affinity for the polyester fabric and are very difficult to remove using conventional laundering procedures. Nevertheless, the trimer particles can release from the fabric and become a source of contamination. Applicant has established a direct correlation between the temperature to which the polyester fiber has been exposed and particulate contamination released from the fabric.

The invention, including alternate embodiments thereof, incorporates the advantages of being adaptable to existing manufacturing processes; reducing particulate contamination on the fiber dramatically; being useful with conventional polyester fibers; and having high sorbency capacity and dimensional stability, as defined above.

DETAILED DESCRIPTION OF THE INVENTION

Figure 1:
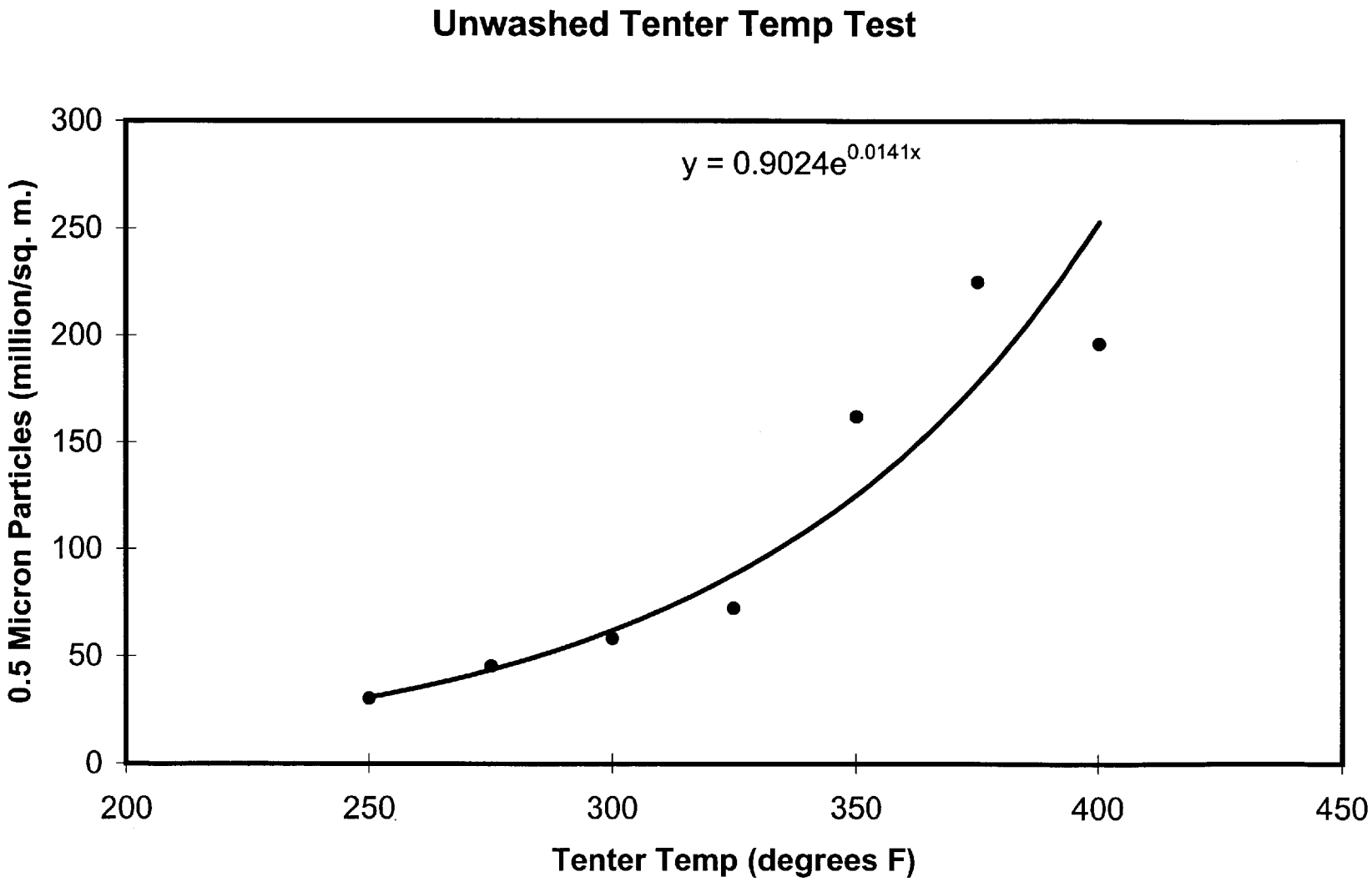
FIG. 1 is a graph of particulate contaminates greater than 0.5 microns (millions per square meter) versus the maximum temperature (degrees F) to which the fabric has been exposed as measured by the Biaxial Shake Test (IEST-RP-CC-004.2 § 5.2) on unlaundered fabric.

Without limiting the scope of the invention, the preferred embodiments and features are hereinafter set forth. Unless otherwise indicated, all parts and percentages are by weight, conditions are ambient, i.e. one atmosphere of pressure and 25° C.

All of the United States patents cited in the specification are hereby incorporated by reference.

The wipers of the present invention may be constructed from woven or knitted polyester fibers, preferably fibers of poly(ethylene terephthalate). It is also preferable to construct the fabrics from continuous filament, polyester yarn. Yams having a wide variety of denier and filament count may be employed. Examples of useful yarns are those having a denier to filament ratio of from 0.1 to 10, a denier of 15 to 250 with filament counts ranging from 10 to 250. A wide range of fabric weights may be employed in the present invention. Typically, the fabrics used for cleanroom wipers have a weight of 1 to 9 ounces per square yard, preferably 3 to 7 ounces per square yard.

The yarn employed in the fabric may be a textured polyester yarn. Such yarns are commercially available and their manufacture is well known in the arts. Briefly, partially oriented yarn (POY) is modified by crimping, imparting random loops, or otherwise modifying the bulk or surface texture of yarn to increase cover, absorbency, resilience, abrasion resistance, warmth, insulation and/or to improve aesthetics. A general description of the texturing process may be found in the Encyclopedia of Textiles, Fibers, and Non-woven Fabrics, Encyclopedia Reprint Series, Ed. Martin Grayson, pages 381–398, John Wiley and Sons (1984) and Dictionary of Fiber and Textile Technology, Hoechst Celanese (1989). The yarn is preferably not heated above a temperature of 300° F. during the texturing process, and generally will not be heated above a temperature of 225° F.

The fabric may be washed or scoured to remove spinning oils, dirt and other contamination. Optionally, the fabric may also be chemically modified with a finish to improve its wettability and washability. Examples of applicable chemical modifications may be found in U.S. Pat. Nos. 3,660,010; 3,676,052; 3,981,807; 3,625,754; 4,014,857; 4,207,071; 4,290,765; 4,068,035; 4,937,277; 3,377,249; 3,535,141; 3,540,835; 3,563,795; 3,598,641; 3,574,620; 3,632,420; 3,650,801; 3,652,212; 3,690,942; 3,897,206; 4,090,844; 4,131,550; 3,649,165; 4,073,993; 4,427,557; 3,620,826; 4,164,392; and 4,168,954. The finish may be applied to the fabric in the form of an aqueous liquor using conventional techniques.

The fabric is heat set to provide dimensional stability, as defined above, which is usually combined with drying the fabric subsequent to washing, scouring or application of miscellaneous finishes. The fabric is preferably heat set at a temperature above what the yarns have previously experienced, after the initial spinning of the fiber. Preferably, the fabric lies flat when it is heat set. The fabric is heat set at a temperature of from 180° to 300° F., preferably from 200° to 275° F., most preferably from 225° to 265° F.

Heat setting may advantageously be performed in a tenter frame oven, in which the fabric is held flat during heating and while it begins to cool. The temperature of the oven may be higher than the temperature actually experienced by the yarn, which will be a function of the oven or dryer temperature profile, length and speed of the fabric through the oven.

The highest temperature which the polyester yarn experiences subsequent to spinning can be determined by Differential Scanning Calorimeter (DSC). Briefly, the method involves heating a sample while measuring heat flow. The highest temperature experienced by the sample appears as a broad peak. In order to minimize generation of particulates, the maximum temperature to which the yarn is heated during any processing step is 300° F. or below, preferably 275° F. or below, most preferably 265° F. or below.

The fabric is cut into nominal sizes for use as a cleanroom wiper, which are preferably squares ranging from 6 inch by 6 inch to 12 inch by 12 inch, with 9 inch by 9 inch squares being common. Any geometric shape may be employed as the shape of the inventive wipes. The fabric is preferably, though not necessarily, cut using a technique which fuses the end of the yarn, thereby preventing unraveling and particle generation. Examples of suitable techniques may be found in Reynolds, U.S. Pat. No. 5,069,735, and the references cited therein.

The inventive wipes may also be utilized in automotive paint rooms where the area itself is not necessarily substantially free from contamination. The low level of contaminants which may be released from the inventive wipes aids in the spray painting of an automobile. Prior to the application of paint coats to the body of the automobile or component part thereof, it may be necessary to clean unwanted liquids or debris from the surface. The inventive wipes provide such a painter with a cleaning article which will deposit a minimum of debris, fibers, or other type of contaminant on the surface to be painted.

Prior to packaging the wipers for use in cleanrooms, it is desirable to wash the fabric or wipers in a cleanroom laundry, which may be characterized as a laundry facility to remove and minimize contamination of the wipers. The cleanroom laundry may employ special filters, surfactants, sequestrants, purified water, etc. to remove oils, reduce particle count and extract undesirable ion contaminates. Examples of suitable equipment and description of cleanroom laundries may be found in Austin, Dr. Philip R., "Encyclopedia of Cleanrooms, Bio-Cleanrooms and Aseptic Areas", Contamination Control Seminars, Michigan (1995).

Testing

Among the standards which may be imposed on cleanroom wipers include performance criteria related to sorbency and contaminates. One standard for evaluating cleanroom wipers is the Institute of Environmental Sciences & Technology (IEST), Contamination Control Division Recommended Practice 004.2, which may be cited as IEST-RP-CC004.2, "Evaluating Wiping Materials Used in Cleanrooms and Other Controlled Environments".

Section 7 of Recommended Practice 004.2 sets forth some of the tests utilized for determining the capacity and rate sorption of cleanroom wipers. The capacity tests is performed by saturating a known area of wiper with a selected liquid and then calculating the volume sorbed per unit mass and per unit area of wiper (IEST-RP-CC004.2 § 7.1). The sorbency per unit mass is referred to as the "intrinsic sorbency" and is the volume of liquid in milliliters sorbed per unit of mass of wiper in grams. The "extrinsic sorbency" is the volume of liquid in milliliters sorbed per unit area of wiper in square meters.

The rate of sorption of a cleanroom wiper is measured by allowing a drop of water to fall from a fixed height onto the surface of a wiper. The time required for the disappearance of specular reflection from the drop is measured and recorded as the sorption rate (IEST-RP-CC004.2 § 7.2).

The primary tests for contamination associated with cleanroom wipers are those measuring particles, unspecified extractable matter, and individual ionic constituents. The number of particles released during wetting and mechanical stress can be measured in the Biaxial Shake Test (IEST-RP-CC004.2 § 5.2). Briefly, the wipers are placed in a jar of water and shaken. Aliquots are removed from the shaker and the number of particles is counted, typically those in the size range of 0.1 microns and larger are specified. The number of particles greater than a given particle size are reported in millions per square meter of fabric.

The amount of extractable contamination associated with a cleanroom wiper is determined by extracting the wiper with a solvent, such as water, isopropyl alcohol or acetone, evaporating the solvent and weighing the non-volatile residue (IEST-RP-CC004.2 § 6.1). The quantity of extracted matter may be reported as mass extracted per mass of wiper or mass extracted per unit area of wiper.

The organic and inorganic non-volatile residue may be further analyzed, when it is desirable to know how much of a particular species is present. Typically, the non-volatile residue is tested for various inorganic, anionic or cationic constituents, for example Al, Ca, Cl, F, Li, Mg, K, Na and Zn (IEST-RP-CC004.2 §6.2).

The invention may be further understood by reference to the following examples.

EXAMPLE 1

The effect of heat setting temperature on particulate contamination was tested as follows.

Partially oriented yarn (POY) was drawn and textured on a false twist texturing machine at a maximum temperature of approximately 180° F. The textured yarn was circular knit into a fabric of approximately 4 ounces per square yard. This fabric was scoured in a jet to remove spinning oils, for 20 minutes at 180° F. The fabric was dried on a tenter frame oven at 250° F., at a speed of 25 yards per minute.

The fabric was rewet, and samples of the fabric were dried and heat set on a tenter frame oven at temperatures ranging from 250° to 400° F. The fabric samples were then cut into 9"×9" squares and tested for particulate contamination according to the Biaxial Shake Test (EST-RP-CC004.2 & 5.2). The results of the test are shown in Table 1 below, and in FIG. 1. The heat history of the fabric was tested using a differential scanning calorimeter (DSC). The highest temperature to which the fabric (and yarn) had been heated is also reported in Table 1 below. Pieces of the fabric were cut and viewed under a scanning electron microscope (SEM). The SEM pictures show very little surface particles on the fabric heat set at 250° F., with increasing surface particles as the heat set temperature is increased to 400° F.

TABLE 1

| Tenter Temperature (degrees F.) | DSC Measured Temp (degrees F.) | Unwashed-greater than 0.5 microns-particles (million particles/sq. meter) |
|---|---|---|
| 250 | 261 | 30 |
| 275 | 288 | 45 |
| 300 | 297 | 58 |
| 325 | 313 | 72 |
| 350 | 351 | 162 |
| 375 | 372 | 225 |
| 400 | 394 | 196 |

EXAMPLE 2

A test was conducted to test the release of particles from wipers which were heat set at various temperatures and were saturated in a mixture of water and 2-propanol.

Two types of partially oriented yarn (POY) were drawn and textured on a false twist texturing machine at a maximum temperature of approximately 180° F. The textured yarns, 70 denier/34 filament and 70 denier/100 filament, were circular knit into a fabric in a 3:1 ratio, respectively, to give a weight of approximately 4 ounces per square yard. This fabric was scoured in a jet to remove spinning oils, for 20 minutes at 180° F. The fabric was designated Style "A". Samples of the fabric were dried in a tenter frame oven at three temperatures: 250° F., 300° F., and 350° F., at speeds of 25, 35, and 50 yards per minute respectively. The fabric was then cut into 9"×9" wipers, and washed and dried in a cleanroom laundry.

These wipers were placed into packages of 50 wipers each and saturated with 540 ml of a mixture of 95% ultrapure water and 5% submicron filtered 2-propanol. These packages were allowed to sit for more than 24 hours. They were then opened and two wipers from each package were tested for particulate contamination according to the Biaxial Shake Test (IEST-RP-CC004.2 & 5.2). Five packages each were tested from the fabric heat set at 250 and 300 degrees. Ten packages were tested from the fabric heat set at 350 degrees. The results of the Biaxial Shake Test are shown below in Table 2. The "small particles" reported are those measuring between 0.5 and 20 microns and the "large particles" reported are those measuring between 5 and 20 microns.

TABLE 2

| Fabric Style | Heat Set Temperature Degrees C. | Small Particles (std. dev.) millions/sq. m. | Large Particles (std. dev.) millions/sq. m. |
|---|---|---|---|
| A | 250 | 17.1 (3.8) | 0.29 (0.04) |
| A | 300 | 22.6 (8.0) | 0.33 (0.20) |
| A | 350 | 57.7 (11.1) | 1.03 (0.22) |

EXAMPLE 3

Three fabric styles were heat set at various temperatures and the absorption capacity, dry weight and thickness were tested.

Fabric Style A of Example 2 was wet out and dried in the tenter frame oven at 250, 275, 300, and 350 degrees F at 40, 45, 53, and 55 yards per minute respectively. Fabric Style B and Style C are circular knit fabrics constructed entirely of 70/34 POY yarn, prepared according to Example 2. Style B weighed 4.0 oz. per square yard and Style C weighed 3.5 oz. per square yard. Both Styles B and C were dried in the tenter frame oven at 250 and 350° F. Then, Styles B and C were cut into wipers, and washed and dried in a cleanroom laundry.

All of the fabrics, Style A, B and C were tested for absorption capacity, dry weight and thickness. Absorption capacity was tested according to IEST-RP-CC004.2 § 7.1 At least three samples were tested from each style. Averages are shown in Table 3, with the standard deviation shown in parentheses.

This data shows that the increased absorption capacity seen with a lower heatset temperature corresponds to increased bulk in the fabric. Samples of the fabric of style A, heatset at 250° F. and at 350° F., was observed under an optical microscope. The fabric at 350° F. has more holes between the knit loops than the more bulky fabric heatset at 250° F.

TABLE 3

| Fabric Style | Heat Set Temp | Absorbency | Dry Weight | Thickness |
|---|---|---|---|---|
| A | 250 | 631 (10) | 158 (3) | 34.2 (0.5) |
| A | 275 | 608 (14) | 156 (3) | 32.8 (0.4) |
| A | 300 | 615 (19) | 158 (4) | 33.0 (0.4) |
| A | 350 | 508 (13) | 150 (3) | 28.0 (0.3) |
| B | 250 | 548 (23) | 141 (1) | 33.3 (0.3) |
| B | 350 | 477 (17) | 143 (3) | 29.4 (0.6) |
| C | 250 | 472 (16) | 117 (4) | 25.7 (0.9) |
| C | 350 | 405 (9) | 117 (2) | 22.5 (0.7) |

The foregoing examples clearly demonstrate the correlation between heat setting the fabric at a temperature below 300° F. and (a) the reduction of contaminates; and (b) increased absorbance capacity of the cleanroom wipers.

Following the process of the present invention it is possible to reduce particulate contamination of particles greater than 0.5 microns to a level of less than 75 million/meters$^2$ for presaturated wipers, and less than 30 million/meters$^2$ for dry packaged wipers, as measured by the Biaxial Shake Test (IEST-RP-CC004.2 § 5.2); to reduce particle contamination of particles greater than 5 microns to a level of less than 25 million/$m^2$ for unlaundered wipers, as measured by the Biaxial Shake Test (IEST-RP-CC004.2 § 5.2); to reduce non-volatile residues with water extraction to less than 0.005 grams/meters$^2$, and even less than 0.003 grams/meters$^2$ as measured by short term extraction (IEST-RP-CC004.2 §6.1.2); and to achieve absorbance capacities of 3.75 milliliters/meters$^2$ or greater, and even 4.0 milliliters/meters$^2$ or greater.

Further, the cleanroom wipers of the present invention demonstrate good dimensional stability, i.e. they remain relatively flat and do not roll up after laundering. The cleanroom wipers find utility in virtually any environment where a low contaminate, high absorbance wiping cloth is desired, such as in semiconductor and pharmaceutical cleanrooms, and in preparation of surfaces for painting or other coating. The wipers may be presaturated with a desired solvent and sold in sealed dispensers, as is well known in the art. Suitable solvents include water, organic solvents such as naphtha, and aqueous solutions of water miscible organic solvents, in particular solutions of alcohols, such as $C_1$–$C_8$ alcohols, especially isopropanol, and water. Of particular interest are wipers presaturated with a solution of isopropanol and water, especially 1 to 99 wt. % isopropanol/water solutions. The solvent composition may also contain a surfactant and/or other additives selected for their cleaning characteristics. By way of example, additional solvents and packages for pre-saturated wipers may be found in the following references: U.S. Pat. No. 3,994,751; U.S. Pat. No. 4,627,936; U.S. Pat. No. 4,639,327; U.S. Pat. No. 4,998,984; U.S. Pat. No. 5,145,091; U.S. Pat. No. 5,344,007 and JP 6[1994]-48475. Alternatively, the wipers may be sealed in air tight packages while dry.

There are, of course, many alternate embodiments and modifications of the invention, which are intended to be included within the scope of the following claims.

What is claimed is:

1. A method of manufacturing a wiper comprising the steps of:

(a) weaving or knitting a fabric from continuous filament, textured, polyester yarn;

(b) heat setting the fabric at a temperature of from 180° to 300° F.;

(c) cutting the fabric to form a wiper; and (d) sealing the wiper in a package;

wherein the yarn has not been heated above a temperature of 300° F.

2. The method of claim 1 wherein the wiper is presaturated with a solvent prior to being sealed in the package.

3. The method of claim 2 wherein the wiper has a particle count of particles greater than 0.5 microns of 75 million particles per square meter or less as measured by Biaxial Shake Test IEST-RP-CC004.2.

4. The method of claim 1 wherein the wiper is laundered prior to being sealed in the package.

5. The method of claim 1 wherein the wiper is dry when sealed in the package.

6. The method of claim 5 wherein the wiper has a particle count of particles greater than 0.5 microns of 30 million particles per square meter or less as measured by Biaxial Shake Test IEST-RP-CC004.2.

7. The method of claim 1 wherein the wiper is heat set at a temperature of from 200° to 275° F., and the yarn has not been heated above a temperature of 275° F.

8. The method of claim 1 wherein the wiper is heat set at a temperature of from 225 to 265° F., and the yarn has not been heated above a temperature of 265° F.

9. The method of claim 1 wherein the wiper has a linear shrinkage of less than 5% when exposed to heat of 175° F. for 5 minutes.

10. The method of claim 1 wherein the wiper has less than 0.005 g/$m^2$ non-volatile residues as measured by Short Term Extraction Test IEST-RP-CC004.2 §6.1.2.

11. The method of claim 1 wherein the wiper has an absorbance capacity of 3.75 milliliters/$m^2$ or greater according to IEST-RP-CC004.2 §7.1.

12. A method of manufacturing a wiper comprising the steps of:

(a) weaving or knitting a fabric from continuous filament, texture, polyester yarn;

(b) heat setting the fabric at a temperature of from 200° to 275° F., while the fabric is held flat; and (c) cutting the fabric to form a wiper; wherein the wiper has a particle count of particles greater than 0.5 microns of 30 million particles per square meter or less as measured by Biaxial Shake Test IEST-RP-CC004.2.

13. The method of claim 12, wherein the yarn has not been heated above 275° F., and the wiper has a linear shrinkage of less than 5% when exposed to heat of 175° F. for 5 minutes.

* * * * *